US005671999A

United States Patent [19]

Guthrie et al.

[11] Patent Number: 5,671,999

[45] Date of Patent: Sep. 30, 1997

[54] FLASHING IDENTIFICATION LIGHT ADAPTOR SYSTEM FOR FLASHLIGHT

[75] Inventors: Phillip K. Guthrie; Charles A. Stundzia, both of Hilton Head Island, S.C.

[73] Assignee: TBI Concepts, L.L.C., Johns Island, S.C.

[21] Appl. No.: 694,166

[22] Filed: Aug. 8, 1996

[51] Int. Cl.[6] ..... F21L 7/00

[52] U.S. Cl. ..... 362/184; 362/205

[58] Field of Search ..... 362/184, 205

[56] References Cited

U.S. PATENT DOCUMENTS 2,493,491 1/1950 MacMahon .
2,520,023 8/1950 Allen .
2,538,332 1/1951 Schaefer .
2,716,700 8/1955 La France .
2,900,493 8/1959 Cheng .
2,900,494 8/1959 Cheng .
2,934,635 4/1960 Cheng .
3,003,057 10/1961 Cheng .
4,527,223 7/1985 Maglica .

*Primary Examiner*—Carroll B. Dority
*Attorney, Agent, or Firm*—Litman, McMahon and Brown, L.L.C.

[57] ABSTRACT

A flashing identification light adaptor system includes a flashing light adaptor with an adaptor housing which is intended to replace the end cap of a conventional flashlight and includes a colored lens removably attached to the adaptor housing in a covering relationship with a light source, which may be a flasher circuit and lamp connected to an independent switch. An insulated conductor is extended within the flashlight barrel to make contact with the positive battery terminal of the flashlight and includes a remote positive terminal positioned proximate the end cap within the flashlight barrel. The adaptor housing includes a positive connector positioned to be aligned with the remote positive terminal when the adaptor is threadably engaged with the flashlight barrel. A pair of indicia arrows can be provided, one on the adaptor and one on the flashlight barrel, to give a positive indication of alignment of the positive connector and remote positive terminal.

7 Claims, 1 Drawing Sheet

FLASHING IDENTIFICATION LIGHT ADAPTOR SYSTEM FOR FLASHLIGHT

BACKGROUND OF THE INVENTION

I. Field of The Invention

The present invention relates to an flashing identification light adaptor system for a flashlight, and, more particularly, to such an adaptor system which includes an adaptor housing which is designed to replace the threaded end cap of a conventional flashlight. The adaptor system uses the existing batteries of the flashlight for electrical power, yet is switched independently of the flashlight itself.

II. Description of The Related Art

Police, firemen and other emergency personnel use flashlights for a variety of reasons, including conventional illumination as well as providing an emergency beacon which allows them to be more easily seen and identified. A tubular multi-cell flashlight made and sold under the MAG trademark has found wide spread use among emergency personnel for its varifocal lens, its durability and resistance to moisture. Such flashlights are generally available with clear lenses and conventional bulbs. However, certain emergency personnel are widely identified with specific colors. For example, police are internationally recognized to use blue as an emergency color while firemen and emergency medical technicians use red. Other emergency personnel, such as tow truck operators, use yellow. Furthermore, it is well known that flashing lights attract greater attention than steady lights.

It is clear then, that a need exists for an attachment which would allow emergency personnel to utilize a conventional flashlight, such as the MAG light mentioned above, to provide independently controlled, colored, flashing light as well.

SUMMARY OF THE INVENTION

The present invention is directed to a flashing identification light adaptor system for a flashlight which includes an adaptor housing which is intended to replace the end cap of a conventional flashlight. The housing includes male threads adapted to mate with the existing end cap female threads on the flashlight. The attachment includes a colored lens removably attached to the adaptor housing in covering relationship with a light source, which may be a lamp controlled by a flasher circuit. An insulated flat conductor is positioned within the flashlight barrel to make contact with the positive battery terminal of the flashlight and the flat conductor connects to a remote positive terminal positioned proximate the end cap threads within the flashlight barrel. The attachment includes a coil spring for making contact with the negative battery terminal within the flashlight and a positive connector is positioned alongside, but insulated from, the coil spring in a position to be aligned with the remote positive terminal when the adaptor is threadably engaged with the flashlight barrel. A pair of indicia arrows can be provided, one on the adaptor housing exterior and one on the flashlight barrel exterior, to give a positive indication of alignment and contact between the positive connector and remote positive terminal when the housing is threaded onto the flashlight barrel.

The positive connector is connected to one terminal of a switch, which may be a slide or push button switch. A second terminal of the switch is connected to a flasher circuit, which circuit provides an intermittent voltage to a lamp in a known fashion. The opposite terminal of the lamp is connected to the coil spring.

A specifically colored identification flashing light adaptor can be provided or a plurality of complete flashing light attachments with accompanying, differently colored lenses can be provided as a kit. As an alternative, the colored lens can be made exchangeable for other, specially colored lenses for specific use by different emergency personnel, as described above.

OBJECTS AND ADVANTAGES OF THE INVENTION

Some of the principle objects and advantages of the invention are: to provide a flashing identification light adaptor system for a flashlight; to provide such an adaptor system which is designed to replace the threaded end cap of a conventional flashlight; to provide such an adaptor system which includes a adaptor housing with a colored lens in covering relationship with a flashing lamp; to provide such an adaptor system in which the lens can be specifically colored for enhanced visibility and for use by specific emergency personnel; to provide such an adaptor system which is powered by the existing batteries in the flashlight; to provide such an adaptor system which is separately switched from the flashlight; and to provide such an adaptor system which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification, include exemplary embodiments of the present invention, and illustrate various objects and features thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
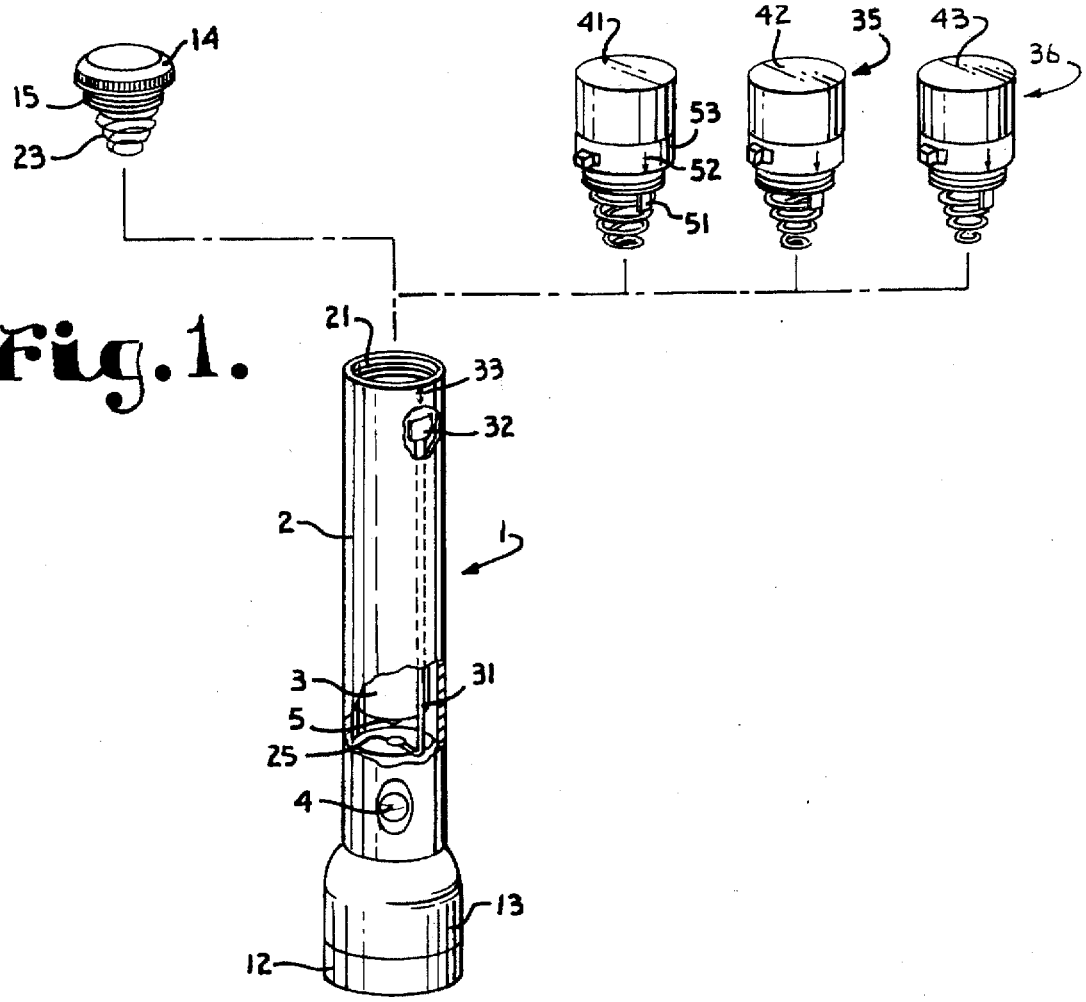
FIG. 1 is an exploded view of the flashing identification light adaptor system for a flashlight in accordance with the present invention, illustrating three differently colored adaptors for a single flashlight.
Figure 2:
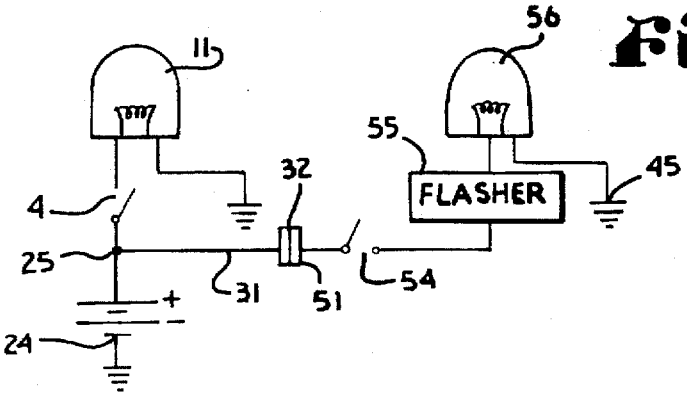
FIG. 2 is a representative electrical schematic diagram of the flashlight of FIG. 1 with the inventive flashing identification light adaptor system connected thereto.

FIG. 1 illustrates a multiple cell tubular flashlight 1 similar to flashlights manufactured and sold under the MAG trademark. The flashlight 1 includes a conventional tubular barrel 2 adapted to hold a number of batteries 3 placed end to end in electrical series. A push button switch 4 selectively connects a positive terminal 5 of the batteries 3 to a flashlight bulb 11. The flashlight 1 includes a variable focus lens 12 controlled by a rotating lens housing 13. An end cap 14 with male threads 15 mates with female threads 21 in an end of the barrel 2. The end cap 14 includes a coil spring 23 which contacts a negative terminal 24 of the batteries 3 to urge them inward to make secure contact between the battery terminal 5 and a flashlight positive terminal 25.

The flashlight 1 as described to this point is entirely conventional. In order to adapt the flashlight 1 to accommodate the inventive flashing identification light adaptor system, an insulated flat conductor 31 is connected to the positive terminal 25. The flat conductor 31 is then extended along the interior of the barrel 2 to a remote positive terminal 32 which itself is insulated from the barrel 2.

The flashlight 1 can be further modified to include an indicia arrow 33 on the exterior of the barrel 2 which arrow 33 is preferably aligned with the positive terminal 32.

A plurality of flashing identification light adaptors 34, 35 and 36 are illustrated in FIG. 1. The flashing identification light adaptor 34 includes a red lens 41, the attachment 35 includes a yellow lens 42 and the attachment 36 includes a blue lens 43. The flashing light adaptors 34–36 can be marketed singly with specific colors or collectively as a kit. As an alternative, the colored lenses 41–43 can be made interchangeable so that a single flashing light adaptor, such as the adaptor 34, can be changed to various colors. The adaptors 34–36 are otherwise identical and thus only adaptor 34 will be further described.

The adaptor 34 includes an adaptor housing 44 which is intended to replace the end cap 14 and includes male threads 45 adapted to mate with the female threads 21 in the barrel 2. The housing 44 also threadably engages the colored lens 41. A coil spring 46 is provided on the housing 44 to contact the negative terminal 24 of the batteries 3 and urge the positive battery terminal 5 into contact with the flashlight positive terminal 25. The flat conductor 31, when the adaptor housing 44 is threadably seated on the barrel 2, thus provides a connection between the positive battery terminal 5 and the remote positive terminal 32. A positive connector 51 is positioned alongside, but insulated from, the coil spring 45. An indicia arrow 52 can be placed on an exterior ring 53 of the housing 44 in alignment with the positive terminal 32. As the adaptor 34 is screwed into the barrel 2, by aligning the indicia arrow 52 with the indicia arrow 33, a user can be assured of an adequate connection between the battery positive terminal 5 and the adaptor 34. Of course, the indicia arrows 33 and 52 can be located anywhere around the upper periphery of the barrel 2 and the ring 53 of the housing 44 as long as they are aligned when the remote positive terminal 32 is in contact with the positive connector 51.

The positive connector 51 is connected to one terminal of a switch 54, shown here as a slide switch. A second terminal of the switch 54 is connected to a flasher circuit 55 which is connected to and controls a lamp 56. The flasher circuit 55, when connected to a source of DC voltage, causes the lamp 56 to intermittently flash on and off in a known manner. The opposite terminal of the lamp 56 is connected to the coil spring 45.

It should be noted that, although arrows 33 and 52 have been shown as aligning indicia, other indicia designs could be used with equal effectiveness. Furthermore, while the conductor 31 is shown as separate from the barrel 2, it could be imbedded into a groove within the interior of the barrel 2, if desired. Although the lamp 56 has been shown as connected directly to the flasher circuit 55, the switch 54 could be a three position switch which provides for alternate connections of the lamp 56 to the flasher circuit 55 or directly to battery voltage should a steady colored light be desired. It should also be understood that the present invention is usable with any standard flashlight and is not limited to use with MAG flashlights.

It is foreseen that the conductor could be made as an integral part of or fixedly connected to the light adaptors 34, 35 and 36 in which case the conductor would cradle the batteries and the need for alignment arrows would be eliminated.

It is also foreseen that each of the adaptors 34, 35 and 36, while still connectable to the flashlight at the location whereat the end cap is removed, could be elongated and include a self contained battery in which case the connector would not be necessary.

It is thus to be understood that while certain forms of the present invention have been illustrated and described herein, it is not to be limited to the specific forms or arrangement of parts described and shown.

What is claimed and desired to be secured by Letters Patent is as follows:

1. A flashing light adaptor system for connection to a flashlight equipped with an end cap with threads mating with cooperating threads in a barrel of the flashlight, the end cap including a spring contacting a first terminal of a battery and urging an opposite terminal of the battery into contact with a positive terminal, said flashing light adaptor system comprising:

a. an adaptor housing adapted to replace said end cap, said adaptor housing being equipped with threads mating with the cooperating threads in the flashlight barrel;

b. a flashing light source positioned within said adaptor housing;

c. a switch selectively connecting the opposite battery terminal to said flashing light source; and d. a colored lens removably attached to said adaptor housing in covering relation with said light source.

2. A flashing light adaptor system as in claim 1, and further comprising:

a. a conductor connectable to said flashlight positive terminal and extendable along the interior of the flashlight barrel;

b. a remote positive terminal electrically connected to said conductor, said secondary positive being attached to the inside of said barrel proximate said threads; and c. a positive connector on said adaptor housing proximate said male threads in a position such that it contacts said remote positive terminal when said adaptor housing is threadably engaged with the barrel.

3. A flashing light adaptor system as in claim 1, and further comprising:

a. a first indicia marker on an outside surface of the barrel; and b. a second indicia marker on an outside surface of said adaptor housing in a position such that, when said adaptor housing is threadably engaged with said barrel and said first and second indicia markers are aligned, said remote positive terminal and said positive connector are in contact.

4. A flashing light adaptor system as in claim 1, and wherein said light source comprises:

a. a flasher circuit which, when connected to a source of DC voltage, produces an intermittent voltage on an output lead; and b. a lamp attached to said flasher circuit output lead.

5. A flashing light adaptor system for connection to a flashlight equipped with an end cap with threads mating with cooperating threads in a barrel of the flashlight, the end cap including a spring contacting a first terminal of a battery in the barrel and urging an opposite terminal of the battery into contact with a positive terminal in the barrel, said flashing light adaptor system comprising:

a. an adaptor housing adapted to replace said end cap, said adaptor housing being equipped with threads mating with the cooperating threads in the flashlight barrel;

b. a flashing light source positioned within said adaptor housing;

c. a switch selectively connecting the opposite battery terminal to said flashing light source;

d. a colored lens removably attached to said adaptor housing in covering relation with said light source;

e. a conductor connectable to said flashlight positive terminal and extendable along the interior of the flashlight barrel;

f. a remote positive terminal electrically connected to said conductor, said secondary positive being attached to the inside of said barrel proximate said threads; and g. a positive connector on said adaptor housing proximate said male threads in a position such that it contacts said remote positive terminal when said adaptor housing is threadably engaged with the barrel.

6. A flashing light adaptor system as in claim 5, and further comprising:

a. a first indicia marker on an outside surface of the barrel; and b. a second indicia marker on an outside surface of said adaptor housing in a position such that, when said adaptor housing is threadably engaged with said barrel and said first and second indicia markers are aligned, said remote positive terminal and said positive connector are in contact.

7. A flashing light adaptor system as in claim 1, and wherein said light source comprises:

a. a flasher circuit which, when connected to a source of DC voltage, produces an intermittent voltage on an output lead; and b. a lamp attached to said flasher circuit output lead.

* * * * *